US009872552B2

(12) United States Patent
Roett-O'Connor

(10) Patent No.: US 9,872,552 B2
(45) Date of Patent: Jan. 23, 2018

(54) KITTY CAT MIRROR

(71) Applicant: JoyAnn S Roett-O'Connor, Alabaster, AL (US)

(72) Inventor: JoyAnn S Roett-O'Connor, Alabaster, AL (US)

(73) Assignee: JoyAnn Roett-O'Connor, Alabaster, AL (US)

( * ) Notice: Subject to any disclaimer, the term of this patent is extended or adjusted under 35 U.S.C. 154(b) by 0 days.

(21) Appl. No.: 14/544,893

(22) Filed: Mar. 6, 2015

(65) Prior Publication Data

US 2015/0265031 A1 Sep. 24, 2015

Related U.S. Application Data

(60) Provisional application No. 61/967,494, filed on Mar. 20, 2014.

(51) Int. Cl.

*A45D 42/10* (2006.01)
*A45D 42/16* (2006.01)
*A45D 44/16* (2006.01)

(52) U.S. Cl.

CPC ..... *A45D 42/10* (2013.01); *A45D 42/16* (2013.01); *A45D 44/16* (2013.01); *Y10T 83/04* (2015.04)

(58) Field of Classification Search

CPC ..... A45D 33/008; A45D 42/08; A45D 42/10; A45D 42/14; A45D 42/16; A45D 42/18; A45D 42/20; A47G 1/02; A61B 1/253; B26B 21/40; F21V 33/004

See application file for complete search history.

(56) References Cited

U.S. PATENT DOCUMENTS

| | | | | | |
|---|---|---|---|---|---|
| 328,740 | A | * | 10/1885 | Wiederer | A45D 42/16 248/166 |
| 3,052,031 | A | * | 9/1962 | Piscitelli | A61B 1/253 359/509 |
| 4,701,594 | A | * | 10/1987 | Powell | A45D 20/16 219/203 |
| 4,733,468 | A | * | 3/1988 | Zadro | B26B 21/40 132/291 |
| 5,359,461 | A | * | 10/1994 | Rice | A45D 20/12 248/469 |
| 5,913,317 | A | * | 6/1999 | Tiram | A45D 42/08 132/289 |

(Continued)

FOREIGN PATENT DOCUMENTS

| | | | |
|---|---|---|---|
| DE | 802468 | * | 2/1951 |
| EP | 1396479 | * | 3/2004 |
| GB | 780078 | * | 7/1957 |

*Primary Examiner* — Rachel Steitz
*Assistant Examiner* — Jennifer Gill

(57) ABSTRACT

Method and apparatus for a standing mirror having a round, flat mirror disposed in substantially the horizontal plane so that it faces upwardly allowing an operator to see hard to reach and see areas of the body. The mirror is disposed in a frame having a conventional razor disposed in a receptacle thereon along with lights disposed in the rim that make the mirror visible for use in darkened areas. Suction tubes disposed on the mirror remove cut hair into a pouch which hangs onto the side of the mirror. A plurality of supporting folding legs having telescoping sections and pivoting sections support the mirror.

20 Claims, 3 Drawing Sheets

(56) References Cited

U.S. PATENT DOCUMENTS 6,382,802 B1 * 5/2002 Goodman ..... A45D 42/16
248/469
6,476,984 B1 * 11/2002 Ringdahl ..... A45D 27/00
132/289

* cited by examiner

KITTY CAT MIRROR

RELATED APPLICATIONS

This application claims benefit of U.S. Provisional Patent Application having Ser. No. 61/967,494 filed on Mar. 20, 2014.

BACKGROUND OF THE INVENTION

Field of the Invention

The present invention relates generally to mirrors and, more particularly, is concerned with a mirror supported on legs.

Description of the Related Art

No patent search has been performed for this invention, therefore, it is possible that devices relevant to the present invention have been described in the related art, however, it also believed that none of the related art, if it exists, discloses the unique features of the present invention.

It is believed that while any related device may be suitable for the purposes for which they were designed, they would not be as suitable for the purposes of the present invention as hereinafter described. As will be shown by way of explanation and drawings, it is believed that the present invention works in a novel manner and differently from the related art.

SUMMARY OF THE PRESENT INVENTION

The present invention discloses a standing mirror for use by men and women to trim and groom hair in hard to see areas of the body which will save the users considerable time and frustration. The present invention discloses a round, flat mirror disposed in substantially the horizontal plane so that it faces upwardly. The mirror is disposed in and is surrounded by a frame having a conventional razor disposed in a receptacle on the rim or frame of the mirror along with lights disposed in the rim that make the mirror visible for use in darkened areas. The present invention also discloses suction tubes disposed on the mirror wherein the cut hair can be vacuumed up and removed into a pouch which hangs onto the side of the mirror in order to collect trimmed hair as the hair falls. The sliding on/off switch on the side of the mirror controls a blower motor. Also shown are a plurality of supporting folding legs having telescoping sections and pivoting sections so that they can be folded into a relatively small area wherein the legs have on their distal ends a claw-like foot with a non-slip surface on its bottom so that when not in use the legs can be collapsed or stored away in a carrying bag.

An object of the present invention is to provide a mirror for use by an operator to trim hair located in hard to reach or see areas of the body. A further object of the present invention is to provide a mirror which is portable and can be easily moved about from one location to another. A further object of the present invention is to provide a standing mirror which can be easily used by an operator. A further object of the present invention is to provide a standing mirror which can be relatively easily and inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
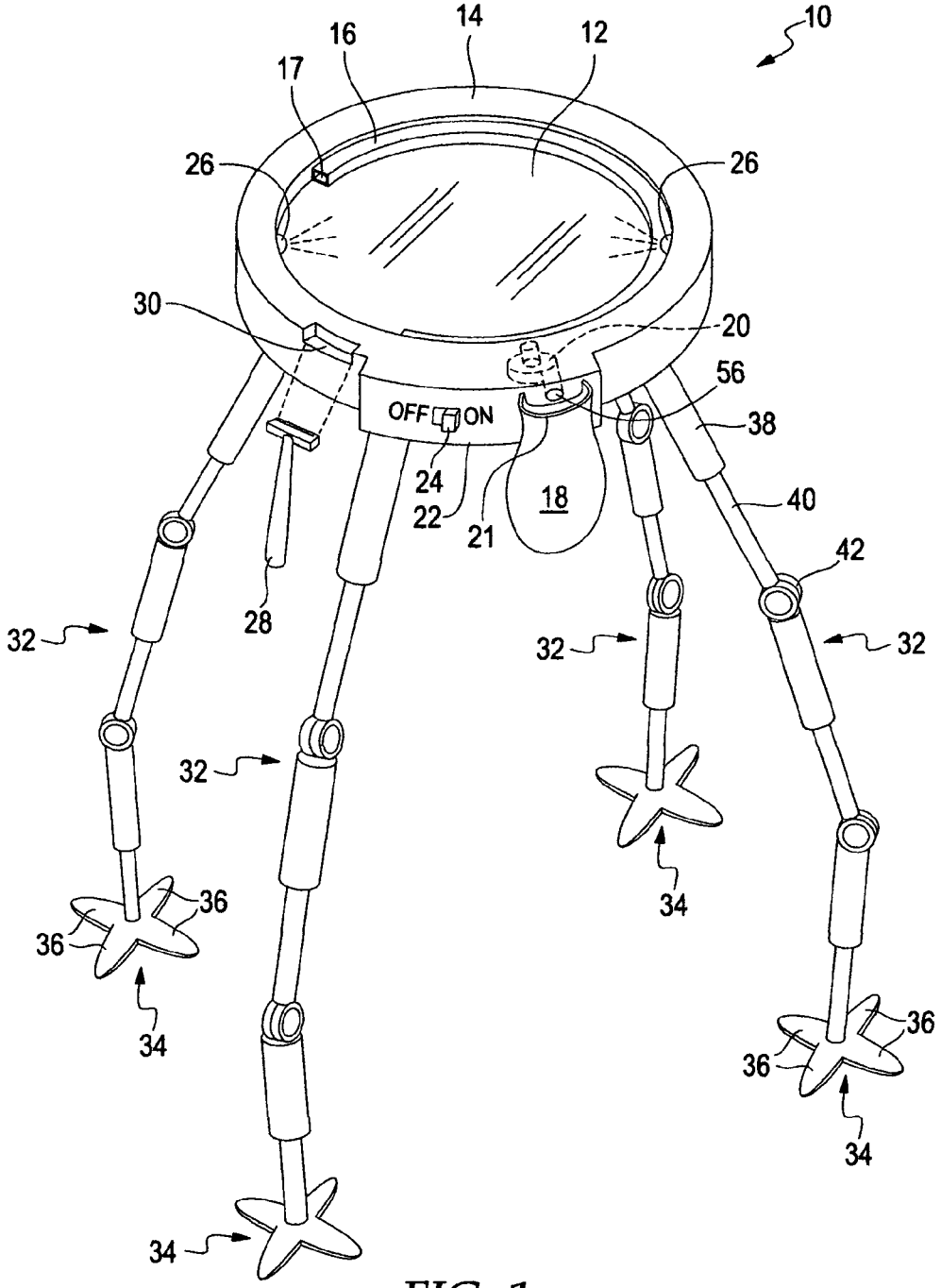
FIG. 1 is a perspective view of the present invention.

With regard to reference numerals used, the following numbering is used throughout the drawings.

10 present invention
12 mirror
14 rim/housing
16 air inlet tube
18 pouch
20 blower
21 inlet of pouch
22 enlarged area of housing
24 switch
26 light
28 razor
30 receptacle
32 leg
34 foot
36 members of foot
38 female portion
40 male portion
42 pivoting portions
44 user
46 hand
48 battery
50 blower
52 electrical connecting wire
54 folded leg
56 air outlet

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 6 illustrate the present invention wherein a standing mirror is disclosed and which is generally indicated by reference number 10.

Turning to FIG. 1, therein is shown the present invention 10 having a mirror portion 12 disposed so that the mirror is substantially in the horizontal plane and mounted in a rim or housing 14 along with at least one air suction inlet tube 16 having inlet 17 wherein hair or other material can be passed therethrough using air flow into a receiving bag or pouch 18 disposed on the side of the rim wherein the hair passes through a blower 20 forming a connection between the inlet tube 16 and an opening or inlet 21 of the bag 18. Also shown is an enlarged area 22 of the rim or housing 14 which contains the blower motor 20 and also including a switch 24 for controlling the operation of the electrical components of the present invention 10. The rim or housing 14 also has a pair of oppositely disposed lights 26 so that the operator can use the present invention 10 in an unlighted area wherein the lights may be LED lights. Also shown is a conventional razor 28 mounted into a receptacle 30 disposed on the rim or housing 14 of the present invention 10. The mirror 12 is supported in a raised or elevated position above the floor by a plurality of legs 32 so that the mirror is held in a position which can be easily visually observed by a user. Each of the plurality of legs 32 comprises multiple female 38 and male 40 sections which are telescopically connected along with pivoting connections 42 and on its distal end having a foot 34 comprised of a plurality of folding members 36. The legs 32 are easily foldable making the present invention 10 easily portable from one location to another.

Figure 2:
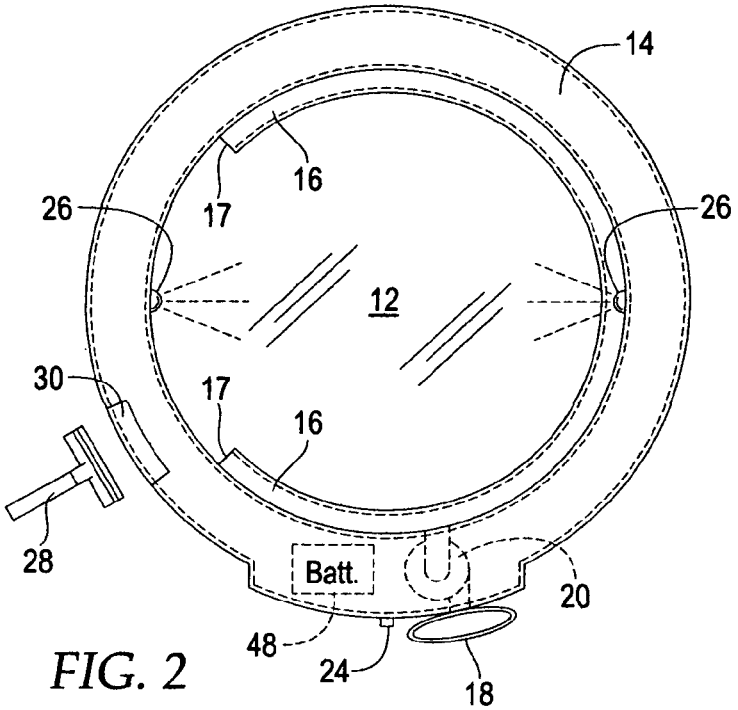
FIG. 2 is a plan view of portions of the present invention.

Turning to FIG. 2, therein is shown the mirror portion 12 mounted in a rim or housing 14 along with at least one air suction tube 16 having at least one inlet 17 wherein cut hair or other material can be passed therethrough using air flow produced by a blower 20 by vacuuming the hair into a receiving bag or pouch 18 disposed on the side of the rim wherein the hair passes through the blower 20 and finally into an opening 21 of the bag 18. Also shown is an enlarged area 22 of the rim or housing 14 which contains the blower 20 along with battery 48. The rim or housing 14 also has a pair of oppositely disposed lights 26 so that the operator can use the present invention 10 in an unlighted area wherein the lights may be LED lights. Also shown is a conventional razor 28 mounted into a receptacle 30 disposed on the rim or housing 14 of the present invention 10.

Figure 3:
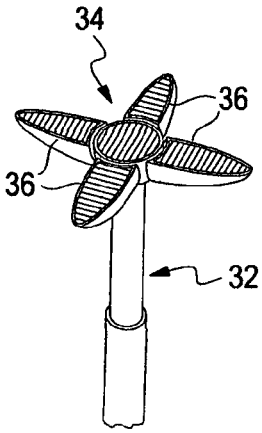
FIG. 3 is a perspective view of portions of the present invention.

Turning to FIG. 3, therein is shown an underside of a foot 34 on a distal end of a leg 32 wherein each of the feet comprises a plurality of members 36 which are each foldable. The feet 34 have soft ribbed bottoms so that the bottoms of the feet provide a gripping surface so that the feet are non-skid and also provides a soft surface to protect the floor or surface upon which the present invention is standing.

Figure 4:
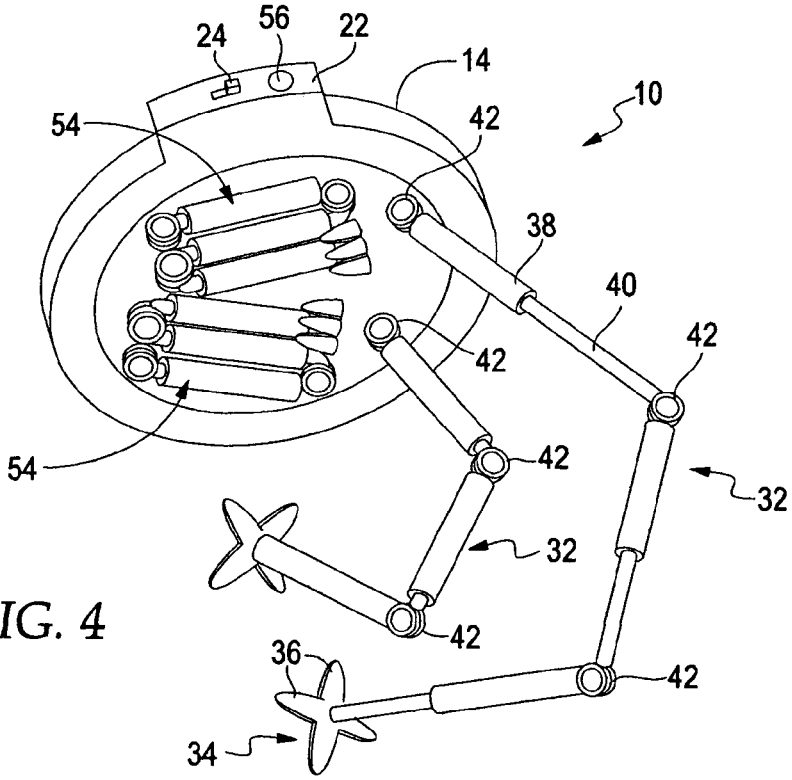
FIG. 4 is a perspective view of the present invention shown in a partially folded position.

Turning to FIG. 4, therein is shown the underside of the mirror 12 being supported by a plurality of legs 32 so that the mirror is held in a position which can be easily visually observed by a user. Each of the legs 32 comprises female 38 and male 40 member sections which are slidably telescopically connected together along with pivoting member connections 42 and on its distal end having a foot 34 comprised of a plurality of folding members 36. The legs 32 are easily foldable as shown at 54 making the present invention 10 easily portable from one location to another. Also shown is the enlarged area 22 of the rim, on/off switch 24 and air outlet 56.

Figure 5:
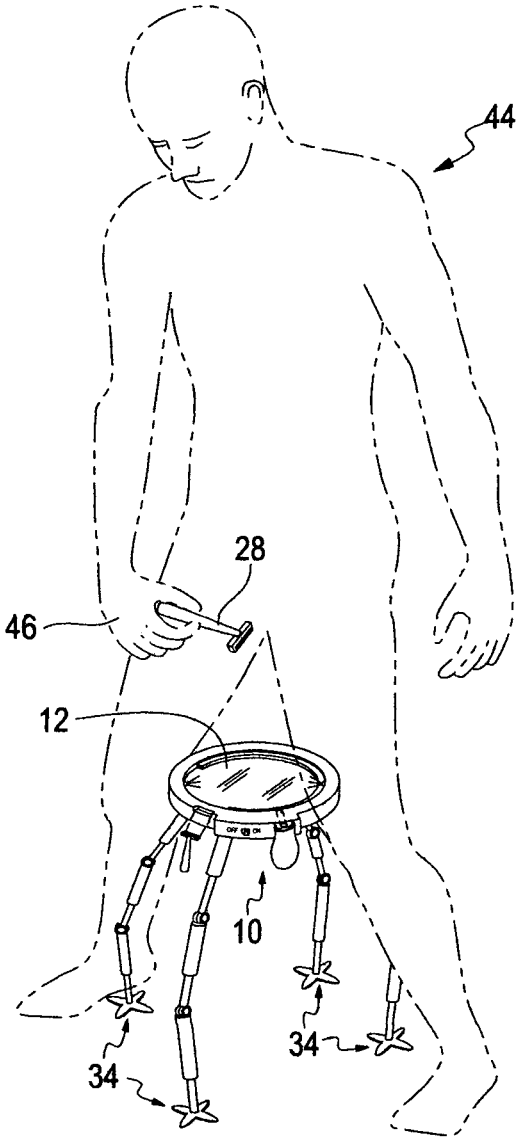
FIG. 5 is a perspective view of the present invention in operative connection.

Turning to FIG. 5, therein is shown the present invention 10 being used by an operator/user 44 wherein the user is holding the razor 28 in his hand 46 so that he can visually see hard to reach/see areas of his body, e.g., the groin area, while standing over and looking into the mirror 12 of the present invention 10 with hands free from holding the mirror. The plurality of feet 34 are shown supporting the present invention 10 on a surface.

Figure 6:
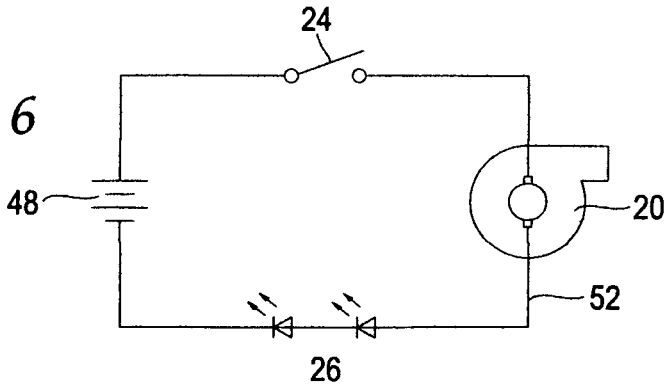
FIG. 6 is an electrical schematic of portions of the present invention.

Turning to FIG. 6, therein is shown an electrical schematic of the electrical components of the present invention including the pair of LED lights 26 along with the on/off switch 24 and battery 48 and blower 20 having a built-in motor wherein the components and electrical connecting line 52 are connected to each other in the standard manner as would be done by one skilled in the art.

What is claimed to be new and desired to be protected by Letters Patent is set forth in the appended claims:

1. An apparatus for trimming hair of a user, the apparatus comprising:

a) a mirror disposed in a housing;

b) at least one air duct disposed on said mirror, said at least one air duct being contiguous with said housing;

c) at least one light disposed on said housing so as to shine light on said mirror;

d) a razor disposed in a receptacle, said receptacle disposed on said housing, said razor for cutting the hair of the user;

e) a pouch disposed on said housing for receiving cut hair;

f) a blower disposed in said housing for vacuuming air through said cut and into said pouch; and, g) a plurality of legs, attached to said housing or said mirror, for supporting said mirror in a substantially horizontal plane so that the user can stand over said mirror with hands free and visually see hair in hard to see areas of a body of the user so that the hair can be cut with said razor.

2. The apparatus of claim 1, wherein at least one of said legs comprises a plurality of telescoping sections and each of said telescoping sections comprises at least one female and at least one male telescoping member to allow said at least one leg to be folded.

3. The apparatus of claim 2, wherein said at least one leg further comprises at least one pivoting portion to allow said at least one leg to be folded.

4. The apparatus of claim 3, wherein said at least one leg further comprises a foot on its distal end.

5. The apparatus of claim 4, wherein each said foot comprises a plurality of folding members to allow said foot to be folded.

6. The apparatus of claim 5, wherein a proximal end, opposite said distal end, of each of said legs connects to an underside of: said mirror or said housing.

7. The apparatus of claim 1, wherein each said foot comprises a non-skid surface disposed on an underside of said foot.

8. The apparatus of claim 1, wherein each of said legs comprises a plurality of telescoping sections and each of said telescoping sections comprises a plurality of female and male telescoping members to allow each of said legs to be folded.

9. The apparatus of claim 1, wherein each of said legs comprises a plurality of telescoping sections and each of said telescoping sections comprises a plurality of female and male telescoping members to allow each of said legs to be folded and each of said legs further comprises a plurality of pivoting portions to allow each of said legs to be folded.

10. The apparatus of claim 1, wherein each of said legs comprises a plurality of telescoping sections and each of said telescoping sections comprises a plurality of female and male telescoping members to allow each of said legs to be folded and each of said legs further comprises a plurality of pivoting portions to allow each of said legs to be folded and each of said legs comprises a foot on its distal end.

11. The apparatus of claim 1, wherein each of said legs comprises a plurality of telescoping sections and each of said telescoping sections comprises a plurality of female and male telescoping members to allow each of said legs to be folded and each of said legs further comprises a plurality of pivoting portions to allow each of said legs to be folded and each of said legs comprises a distal foot comprising a plurality of folding foot members allowing said foot to be folded.

12. The apparatus of claim 1, wherein each of said legs comprises a plurality of telescoping sections and each of said telescoping sections comprises a plurality of female and male telescoping members to allow each of said legs to be folded and each of said legs further comprises a plurality of pivoting portions to allow each of said legs to be folded and each of said legs comprises a distal foot comprising a plurality of folding foot members allowing said foot to be folded and a non-skid surface is provided on an underside of each said foot.

13. A method for trimming the hair of a user with the apparatus of claim 1, comprising the steps of:

a) providing an apparatus according to claim 1 b) supporting the mirror in the substantially horizontal plane using the plurality of legs so that the user can stand over the mirror with hands free and visually see the hair in hard to see areas of the body of the user;

c) lighting the mirror with said light;

d) cutting hair of a user with the razor in the receptacle;

e) vacuuming air and the cut hair of the user through the air duct and into the pouch.

14. The method of claim 13, wherein at least one of said legs of said apparatus includes at least one telescoping section and each said telescoping section comprises a female and a male telescoping member to allow said at least one leg to be folded.

15. The method of claim 14, wherein at least one of said legs of said apparatus comprises at least one pivoting portion to allow said at least one leg to be folded.

16. The method of claim 15, wherein at least one of said legs has foot on its distal end.

17. The method of claim 16, wherein each said foot comprises a plurality of folding members to allow each said foot to be folded.

18. The method of claim 17, wherein a proximal end, opposite said distal end, of each of said legs connects to an underside of: said mirror or said housing.

19. The method of claim 18, further comprising a step of providing a non-skid surface on an underside of each said foot.

20. The method of claim 13, wherein each of said legs of said apparatus comprises a plurality of telescoping sections and each of said telescoping sections comprises a plurality of female and male telescoping members to allow each of said legs to be folded and each of said legs further comprises a plurality of pivoting portions to allow each of said legs to be folded and each of said legs comprises a distal foot comprising a plurality of folding foot members allowing said foot to be folded and a non-skid surface is provided on an underside of each said foot.

* * * * *